US005144934A

United States Patent [19]

Miyashita et al.

[11] Patent Number: 5,144,934

[45] Date of Patent: Sep. 8, 1992

[54] AIR-FUEL RATIO CONTROL METHOD FOR INTERNAL COMBUSTION ENGINES

[75] Inventors: Yukio Miyashita; Hiroshi Mifune; Atsushi Matsubara, all of Wako, Japan

[73] Assignee: Honda Giken Kogyo Kabushiki Kaisha, Tokyo, Japan

[21] Appl. No.: 769,704

[22] Filed: Oct. 2, 1991

[30] Foreign Application Priority Data

Oct. 5, 1990 [JP] Japan ..... 2-268096

[51] Int. Cl.[5] ..... F02D 41/12; F02D 41/14

[52] U.S. Cl. ..... 123/682

[58] Field of Search ..... 123/325, 326, 489, 493

[56] References Cited

U.S. PATENT DOCUMENTS 4,174,682 11/1979 Drews et al. ..... 123/489 X
4,697,559 10/1987 Suzuki et al. ..... 123/489
4,723,521 2/1988 Mieno et al. ..... 123/489
4,907,558 3/1990 Manaka et al. ..... 123/489 X
4,953,513 9/1990 Sasaki et al. ..... 123/489
4,958,612 9/1990 Kato et al. ..... 123/489 X
4,981,122 1/1991 Osawa et al. ..... 123/489 X

FOREIGN PATENT DOCUMENTS 62-251443 11/1987 Japan .

*Primary Examiner*—Willis R. Wolfe
*Attorney, Agent, or Firm*—Armstrong & Kubovcik

[57] ABSTRACT

An air-fuel ratio control method for an internal combustion engine, in which the air-fuel ratio of a mixture supplied to the engine is feedback-controlled to a desired air-fuel ratio in response to output from an exhaust gas ingredient concentration sensor. When the engine is in a predetermined decelerating condition, fuel supply to the engine is cut off. The rate of correction of the air-fuel ratio of the mixture by the feedback control is set to a larger value before a predetermined time period elapses after the engine shifted from the predetermined decelerating condition to another operating condition, than values to be set after the predetermined time period has elapsed.

9 Claims, 5 Drawing Sheets

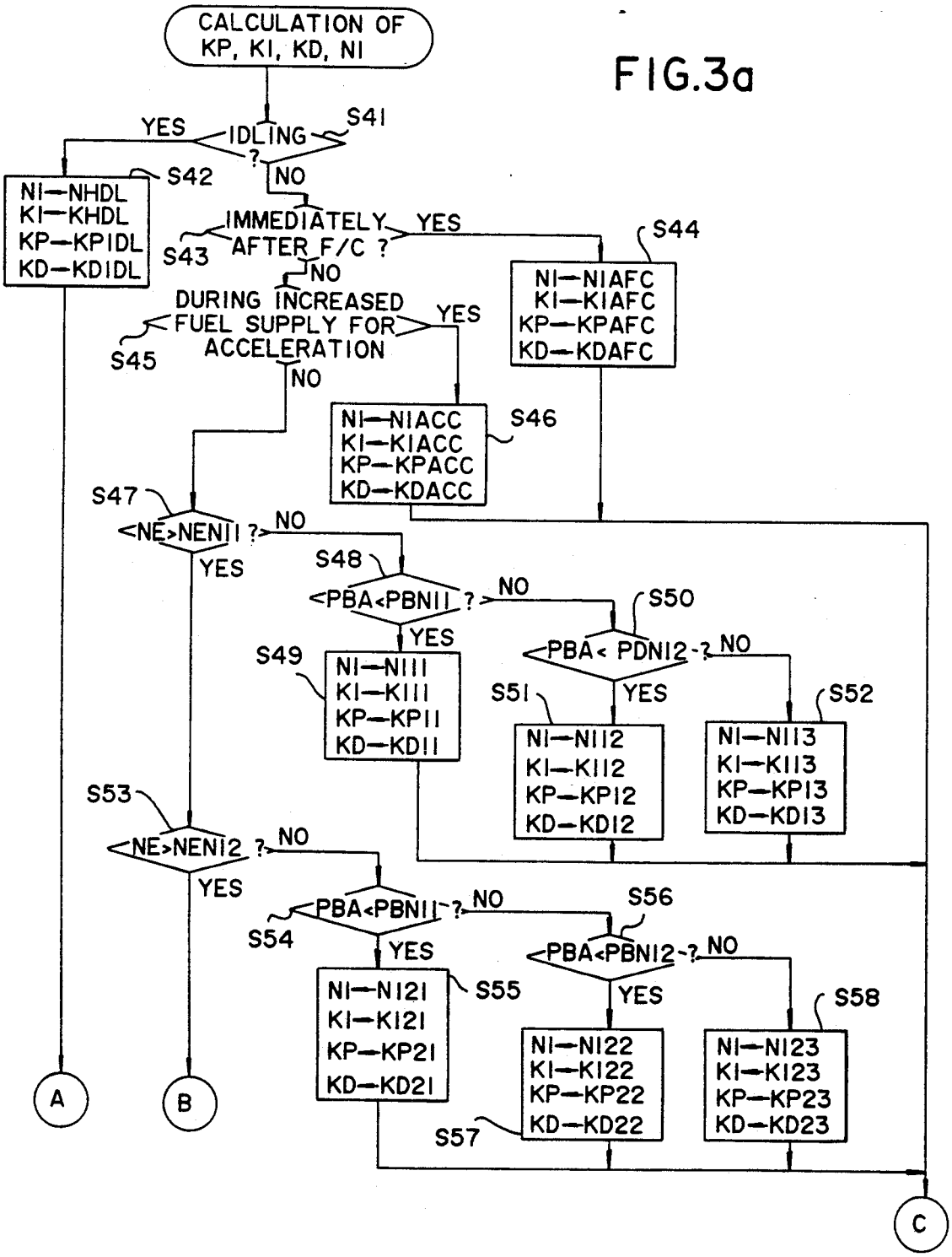
CALCULATION OF KP, KI, KD, NI
FIG.3a
IDLING ?
S41
YES
NO
S42
NI—NHDL
KI—KHDL
KP—KPIDL
KD—KDIDL
IMMEDIATELY AFTER F/C ?
S43
YES
NO
S44
NI—NIAFC
KI—KIAFC
KP—KPAFC
KD—KDAFC
DURING INCREASED FUEL SUPPLY FOR ACCELERATION
S45
YES
NO
NI—NIACC
KI—KIACC
KP—KPACC
KD—KDACC
S46
S47
<NE>NENI1 ?
NO
YES
S48
<PBA<PBNI1 ?
NO
YES
S49
NI—NI11
KI—KI11
KP—KP11
KD—KD11
S50
PBA< PDNI2 ?
NO
YES
S51
NI—NI12
KI—KI12
KP—KP12
KD—KD12
S52
NI—NI13
KI—KI13
KP—KP13
KD—KD13
S53
<NE>NENI2 ?
NO
YES
S54
PBA<PBNI1 ?
NO
YES
S55
NI—NI21
KI—KI21
KP—KP21
KD—KD21
S56
PBA<PBNI2 ?
NO
YES
S57
NI—NI22
KI—KI22
KP—KP22
KD—KD22
S58
NI—NI23
KI—KI23
KP—KP23
KD—KD23
A
B
C

AIR-FUEL RATIO CONTROL METHOD FOR INTERNAL COMBUSTION ENGINES

BACKGROUND OF THE INVENTION

The present invention relates to a method of controlling the air-fuel ratio of an internal combustion engine, and more particularly, to a method of this kind wherein the air-fuel mixture supplied to the engine is feedback-controlled to a desired air-fuel ratio in response to the output of an exhaust gas ingredient concentration sensor having output characteristics in approximate proportion to the exhaust gas ingredient concentration.

Among conventional methods of feedback-controlling the air-fuel ratio of an air-fuel mixture supplied to an internal combustion engine (referred to hereinafter as "supply air-fuel ratio") to a desired air-fuel ratio in response to the output of an exhaust gas ingredient concentration sensor having output characteristics proportional to the exhaust gas ingredient concentration, there is a method proposed e.g. by Japanese Provisional Patent Publication (Kokai) No. 62-251443, in which a proportional term (P term), an integral term (I term), and a differential term (D term) are calculated based on a difference between an actual air-fuel ratio detected by the exhaust gas ingredient concentration sensor and a desired air-fuel ratio, and by the use of these calculated P, I, and D terms the supply air-fuel ratio is feedback-controlled.

However, according to this conventional method, feedback gains applied to calculation of the P, I, and D terms are set based on the engine rotational speed and the difference between the actual air-fuel ratio and the desired air-fuel ratio, but not set with other operating parameters of the engine taken into consideration. Therefore, the proposed method has the following disadvantage:

When the engine is in a predetermined decelerating condition, cutting-off of the fuel supply (hereinafter referred to as "fuel cut") is carried out. During fuel cut, the feedback control of the air-fuel ratio cannot be performed. Therefore, it is impossible to make the supply air-fuel ratio rapidly follow the desired air-fuel ratio immediately after termination of fuel cut, which may result in degradation of exhaust emission characteristics and driveability of the engine.

SUMMARY OF THE INVENTION

It is therefore the object of the invention to provide an air-fuel ratio control method for an internal combustion engine, which is capable of properly performing the feedback control of the air-fuel ratio immediately after termination of fuel out, to thereby prevent exhaust gas emission characteristics and driveability of the engine from being degraded.

To attain the above object, the present invention provides an air-fuel ratio control method for an internal combustion engine having an exhaust passage, and an exhaust gas ingredient concentration sensor arranged in the exhaust passage for detecting the concentration of an ingredient in exhaust gases from the engine, wherein an amount of fuel to be supplied to the engine is calculated by the use of output from the exhaust gas ingredient concentration sensor to thereby feedback-control the air-fuel ratio of a mixture supplied to the engine to a desired air-fuel ratio, and when the engine is in a predetermined decelerating condition, fuel supply to the engine is cut off.

The air-fuel ratio control method according to the invention is characterized by comprising the steps of:

(1) determining whether or not a predetermined time period has elapsed after the engine shifted from the predetermined decelerating condition to an operating condition other than the predetermined decelerating condition; and (2) setting a rate of correction of the air-fuel ratio of the mixture by the feedback control to a larger value before the predetermined time period elapses after the engine shifted from the predetermined decelerating condition to the operating condition other than the predetermined decelerating condition, than values to be set after the predetermined time period has elapsed after the engine shifted from the predetermined decelerating condition to the operating condition other than the predetermined decelerating condition.

The exhaust gas ingredient concentration sensor has output characteristics approximately proportionate to the concentration of the ingredient in the exhaust gases.

Preferably, the amount of fuel to be supplied to engine is determined by multiplying a basic fuel amount by a desired air-fuel ratio coefficient representing the desired air-fuel ratio, and an air-fuel ratio correction coefficient calculated based on the desired air-fuel ratio coefficient and an equivalent ratio representing an actual air-fuel ratio which is commensurate with the output from the exhaust gas ingredient concentration sensor, the rate of correction of the air-fuel ratio of the mixture by the feedback control being determined by a rate of correction of the air-fuel ratio correction coefficient.

More specifically, the air-fuel ratio correction coefficient is obtained by adding up a proportional term, an integral term, and a differential term, the proportional, integral and differential terms being calculated by the use of respective predetermined coefficients and a difference between the desired air-fuel ratio coefficient and the equivalent ratio representing the actual air-fuel ratio, the rate of correction of the air-fuel ratio correction coefficient being determined by the predetermined coefficients.

The proportional, integral and differential terms are calculated by multiplying the respective predetermined coefficients by the difference between the desired air-fuel ratio coefficient and the equivalent ratio, the respective predetermined coefficients being set to larger values before the predetermined time period elapses after the engine shifted from the predetermined decelerating condition to the operating condition other than the predetermined decelerating condition, than values to be set after the predetermined time period has elapsed after the engine shifted from the predetermined decelerating condition to the operating condition other than the predetermined decelerating condition.

Preferably, the desired air-fuel ratio coefficient having a value thereof assumed a second predetermined time period earlier than a present time is applied to the calculation of the proportional, integral and differential terms.

Specifically, the second predetermined time period is determined by a number of TDC signal pulses generated during a time period from the time fuel injection is effected to the time the resulting exhaust gases reach the exhaust gas ingredient concentration sensor.

In the meanwhile, the air-fuel ratio correction coefficient is renewed whenever a predetermined number of TDC signal pulses are generated, the predetermined number of TDC signal pulses being dependent on operating conditions of the engine, the rate of correction of the air-fuel ratio correction coefficient being also determined by the predetermined number of TDC signal pulses.

More specifically, the predetermined number of TDC signal pulses is set to a smaller value before the predetermined time period elapses after the engine shifted from the predetermined decelerating condition to the operating condition other than the predetermined decelerating condition, than values to be set after the predetermined time period has elapsed after the engine shifted from the predetermined decelerating condition to the operating condition other than the predetermined decelerating condition.

The above and other objects, features and advantages of the invention will be more apparent from the ensuing detailed description taken in conjunction with the accompanying drawings.

BRIEF DESCRIPTION OF THE DRAWINGS

FIGS. 3*a* and 3*b* are flowcharts of a program for setting a thinning-out number (NI) and gains (KI, KP, KD) of feedback control.

DETAILED DESCRIPTION

The method according to the invention will now be described in detail with reference to the drawings showing an embodiment thereof.

Figure 1:
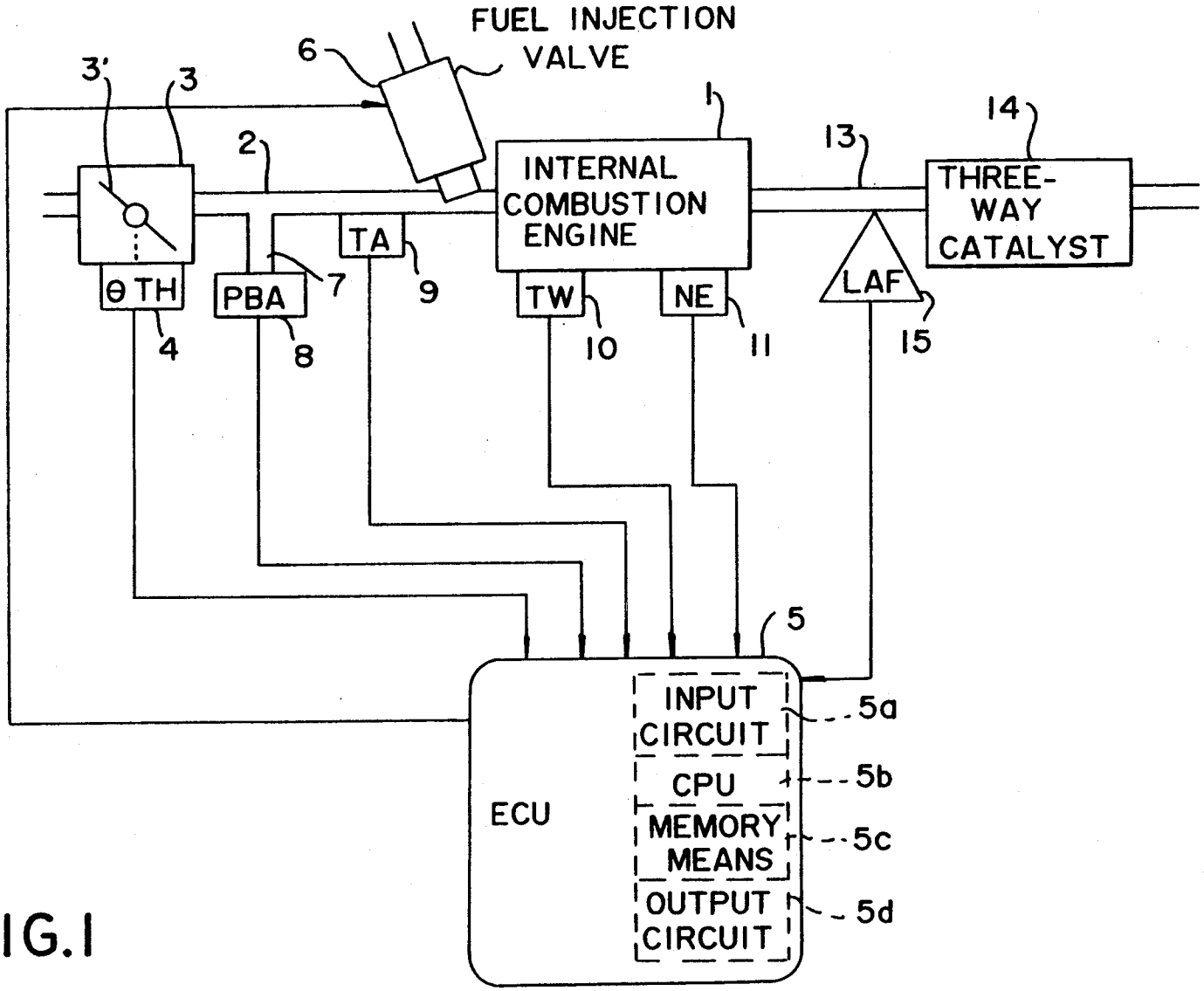
FIG. 1 is a block diagram illustrating the whole arrangement of a fuel supply control system for carrying out the control method of the invention.

Referring first to FIG. 1, there is shown the whole arrangement of a fuel supply control system which is adapted to carry out the control method of this invention. In an intake pipe 2 of an engine 1, there is arranged a throttle body 3 accommodating a throttle body 3' therein. A throttle valve opening (θTH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe between the engine 1 and the throttle valve 3, and at a location slightly upstream of an intake valve, not shown. The fuel injection valves 6 are connected to a fuel pump, not shown, and electrically connected to the ECU 5 to have their valve opening periods controlled by signals therefrom.

In the meanwhile, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature (TA) sensor 9 is inserted into the intake pipe 2 at a location downstream of the intake pipe absolute pressure sensor 8 for supplying an electric signal indicative of the sensed intake temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed in the CPU 5*b* and for storing results of calculations therefrom, etc., and an output circuit 5*d* which outputs driving signals to the fuel injection valves 6.

The CPU 5*b* operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT} = Ti \times KCMDM \times KLAF \times K_1 + K_2 \quad (1)$$

where $T_i$ represents a basic fuel amount, more specifically a basic fuel injection period which is determined according to the engine rotational speed Ne and the intake pipe absolute pressure PBA. The value of Ti is determined by a Ti map stored in the memory means 5*c*.

KCMDM is a modified desired air-fuel ratio coefficient which is calculated by multiplying a desired air-fuel ratio coefficient KCMD set according to engine operating conditions and representing a desired air-fuel ratio by a fuel cooling correction coefficient KETV. The correction coefficient KETV is intended to apply a prior correction to the fuel injection amount in view of the fact that the supply air-fuel ratio varies due to the cooling effect produced when fuel is actually injected, and its value is set according to the value of the desired air-fuel ratio coefficient KCMD. Further, as will be clear from the aforementioned equation (1), the fuel injection period $T_{OUT}$ increases if the desired air-fuel ratio coefficient KCMD increases, so that the values of KCMD and KCMDM will be in direct proportion to the reciprocal of the air-fuel ratio A/F.

KLAF is an air-fuel ratio correction coefficient which is calculated by a program described hereinafter with reference to FIG. 2 and set such that during feedback control the air-fuel ratio detected by the LAF sensor 15 will become equal to the desired air-fuel ratio, and is set to predetermined values depending on engine operating conditions during open-loop control.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU **5*b* performs calculations as described hereintofore, and supplies the fuel injection valves 6 with driving signals based on the calculation results through the output circuit 5*d***.

Figure 2:
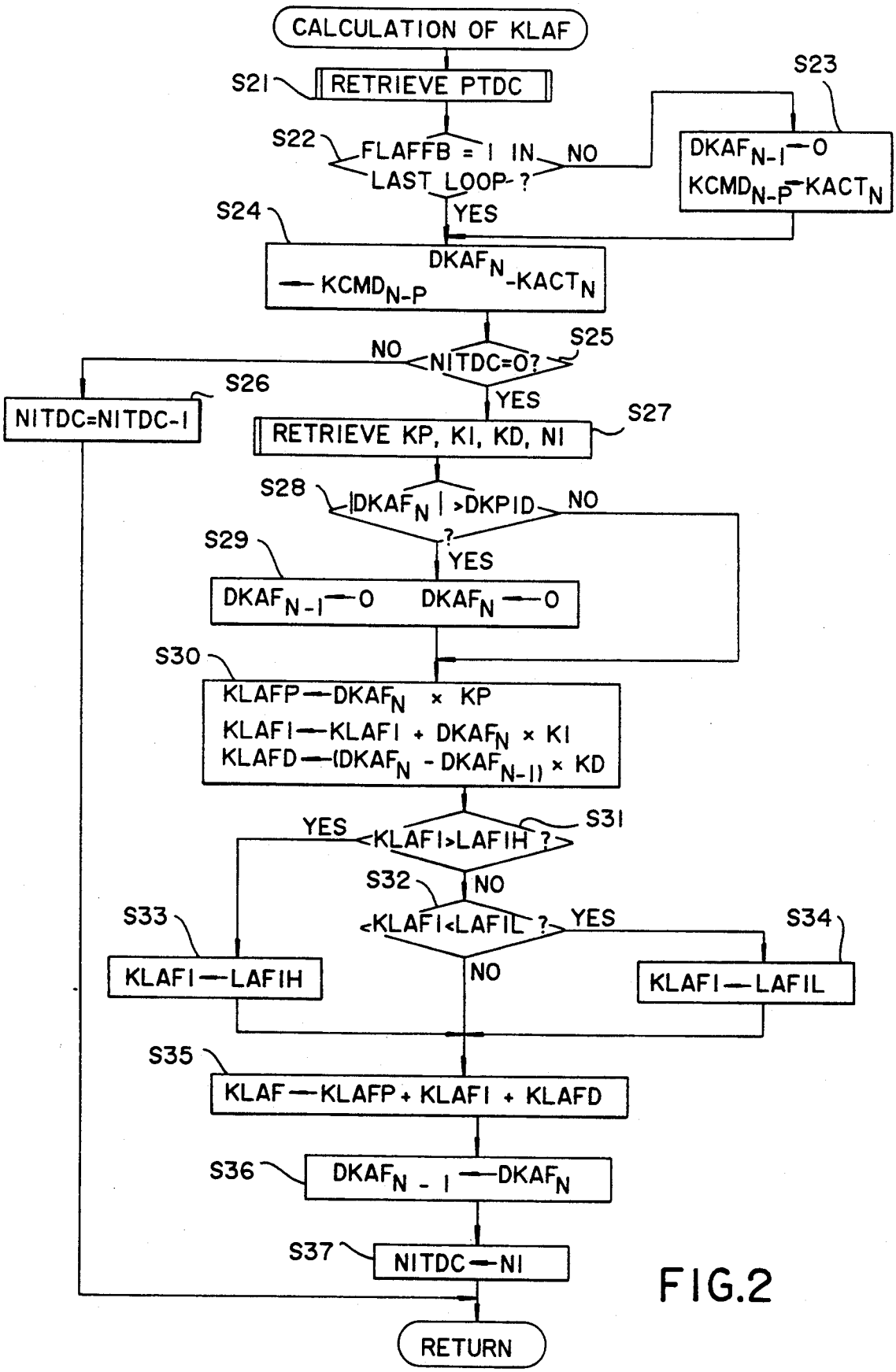
FIG. 2 is a flowchart of a program for calculating an air-fuel ratio correction coefficient KLAF.

FIG. 2 shows a program which calculates the air-fuel ratio correction coefficient KLAF. This program is carried out in synchronism with inputting of each TDC signal pulse to the ECU 5.

At a step S21, a time lag TDC variable PTDC which indicates a time lag before exhaust gases reach the LAF sensor 15, by the number of TDC signal pulses, is read from a PTDC table set in accordance with the intake pipe absolute pressure PBA. The PTDC table is set based on the fact that the time period from the time fuel is injected into the intake pipe 2 to the time the resulting exhaust gases reach the LAF sensor 15 varies with the intake pipe absolute pressure PBA. According to the PTDC table, the time lag TDC variable is set to a smaller value as the intake pipe absolute pressure PBA is higher.

At a step S22, it is determined whether or not a flag FLAFFB, which is set to a value of 1 when the air-fuel ratio feedback control is being performed, assumed a value of 1 when an immediately preceding TDC signal pulse was generated (i.e. in the last loop of the present program). If the answer to this question is affirmative (Yes), the program immediately proceeds to a step S24, whereas if the answer is negative (No), an immediately preceding value (i.e. a value obtained in the last loop) $DKAF_{N-1}$ of a difference between an equivalent ratio (hereinafter referred to as the "actual air-fuel ratio") representing an air-fuel ratio detected by the LAF senor 15 and a desired air-fuel ratio coefficient KCMD is set to a value of 0, and at the same time a value $KCMD_{N-P}$ of the desired air-fuel ratio coefficient assumed P loops before the present loop is set to a present value $KACT_N$ of the actual air-fuel ratio, at a step S23, followed by the program proceeding to the step S24. Here, "P" is equal to a value of the time lag TDC variable PTDC calculated at the step S21.

At the step S24, a present value $DKAF_N$ of the difference between the actual air-fuel ratio and the desired air-fuel ratio coefficient KCMD is calculated by subtracting a present value KACTN of the actual air-fuel ratio from the value $KCMD_{N-P}$ of the desired air-fuel ratio assumed P loops before the present loop. If this step is reached by way of the step 23, $KCMD_{N-P}=KACT_N$ so that $DKAF_N=0$.

At the following step S25, it is determined whether or not a thinning-out TDC variable NITDC is equal to 0. If the answer to this question is negative (No), the thinning-out TDC variable NITDC is decreased by a decrement of 1 at a step S26, followed by terminating the present program. The thinning-out TDC variable NITDC is used for renewing the air-fuel ratio correction coefficient KLAF whenever a thinning-out number NI of TDC signal pulses have been generated, the thinning-out number NI being set depending on operating conditions of the engine. If the answer to the question of the step S25 is affirmative (Yes), i.e. if NITDC=0, the program proceeds to a step S27 et seq. where the air-fuel ratio correction coefficient KLAF is renewed.

Figure 3B:
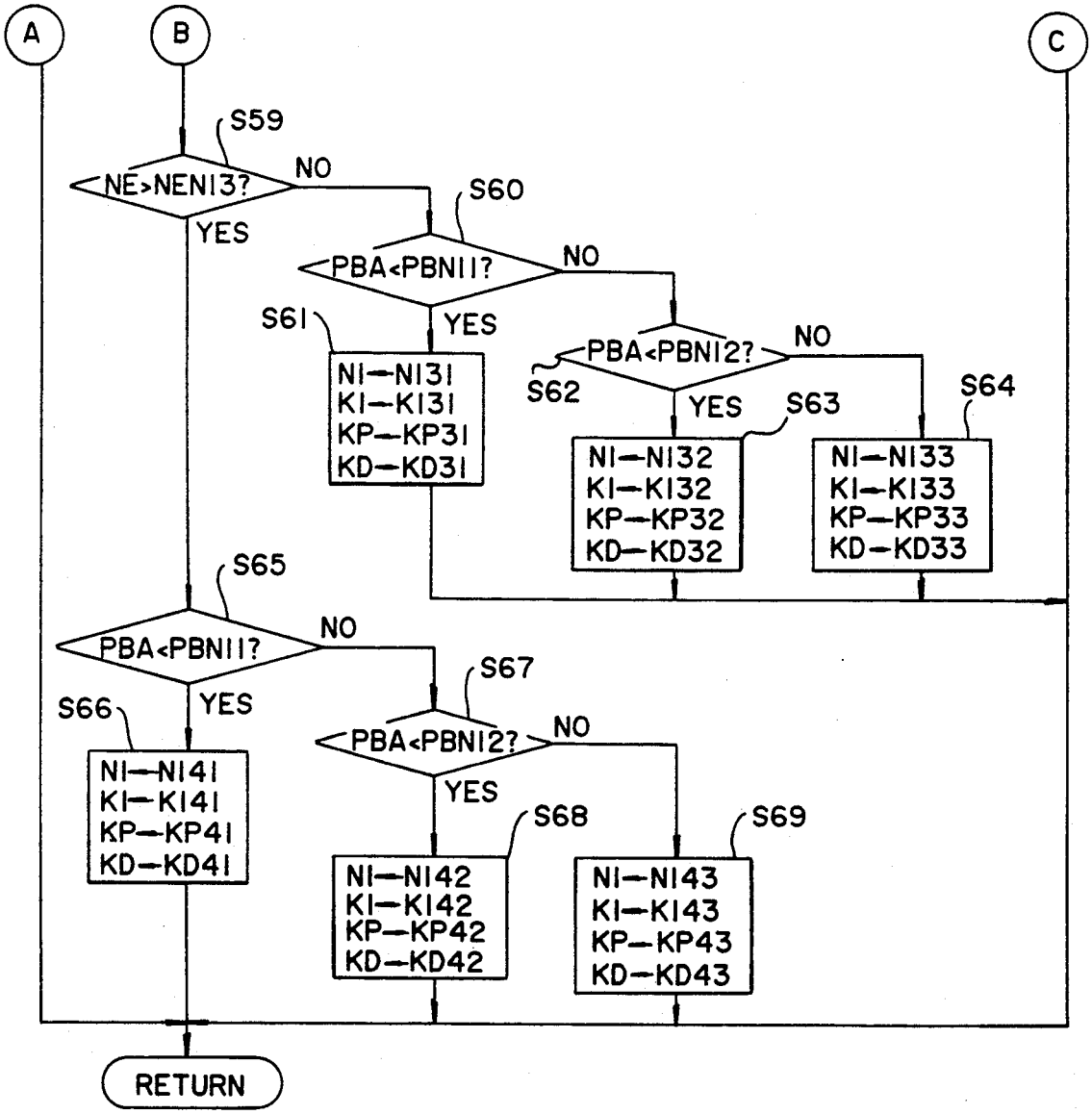

At the step S27, by a subroutine shown in FIG. 3, there are calculated a proportional term (P term) coefficient KP, an integral term (I term) coefficient KI, and a differential term (D term) coefficient KD. the coefficients serving as feedback gains, and the thinning-out number NI.

In FIG. 3, first at a step S41, it is determined whether or not the engine is idling. If the answer to this question is affirmative (Yes), the thinning-out number NI and the coefficients KI, KP, and KD are set to respective predetermined values NIIDL, KIIDL, KPIDL, and KDIDL (e.g. 4, 0.063, 0, 0, respectively) for idling at a step S42. If the answer to the question is negative (No), i.e. if the engine is not idling, it is determined at a step S43 whether or not the present loop is executed immediately after fuel cut. Here, the expression "immediately after fuel cut" means "before a predetermined time period corresponding to a predetermined number of TDC signal pulses elapses after termination of fuel cut". If the answer to the question of the step S43 is affirmative (Yes), i.e. immediately after fuel cut, the thinning-out number NI and the coefficients KI, KP, KO are set to respective predetermined values NIAFC, KIAFC, KPAFC, KDAFC (e.g. 2, 0.6, 1.2, 0.8, respectively) to be applied immediately after fuel cut, at a step S44.

Here, the thinning-out number NIAFC to be applied immediately after fuel cut assumes a value smaller than those to be applied after the lapse of the predetermined time period after termination of fuel cut, and the PID coefficients KPAFC, KIAFC, KDAFC assume values larger than those applied after the lapse of the predetermined time period. This contemplates the fact that during fuel cut, the air-fuel ratio correction coefficient KLAF is held constant to interrupt the feedback control. By setting the thinning-out number NI and the coefficients NI, KI, KP, and KD in this manner, a rate (speed) increases immediately after termination of fuel cut, at which the supply air-fuel ratio is corrected in response to the difference DKAF between the actual air-fuel ratio and the desired air-fuel ratio, which enables to make the supply air-fuel ratio rapidly follow the desired air-fuel ratio. As a result, it is possible to prevent degradation of exhaust emission characteristics and driveability which would otherwise occur immediately after termination of fuel cut.

If the answer to the question of the step S43 is negative (No), i.e. if the present loop is not one immediately after fuel cut, it is determined at a step S45 whether or not increased fuel supply for acceleration (i.e. supply of an increased amount of fuel when the engine is accelerating) is being carried out. If the answer to this question is affirmative (Yes), the thinning-out number NI and the coefficients KI, KP, KD are set to respective predetermined values NIACC, KIACC, KPACC, and KDACC (e.g. 4, 0.063, 0, 0, respectively) for increased fuel supply for acceleration at a step S46.

The thinning-out number NIACC for increased fuel supply for acceleration is set to a value larger than those applied when the engine is in any of the other operating conditions, and the PID coefficients KPACC, KIACC, and KDACC for increased fuel supply for acceleration are set to values smaller than those applied when the engine is in any of the other operating conditions. This contemplates the fact that while increased fuel supply is being carried out, the actual air-fuel ratio is deviated in an enriching direction due to another coefficient applied for increased fuel supply for acceleration, but if the air-fuel ratio correction coefficient KLAF is changed rapidly in response to this deviation, the supply air-fuel ratio is largely deviated in an leaning direction upon termination of increased fuel supply for acceleration, i.e. excessive correction of the supply air-fuel ratio results. By setting the thinning-out number NI and the PID coefficients KI, KP, KD in this manner, the rate (speed) of correction of the supply air-fuel ratio is decreased, so that during increased fuel supply for acceleration, the supply air-fuel ratio relatively slowly follows the desired air-fuel ratio, which enables to prevent degradation of driveability immediately after termination of increased fuel supply for acceleration.

Figure 4:
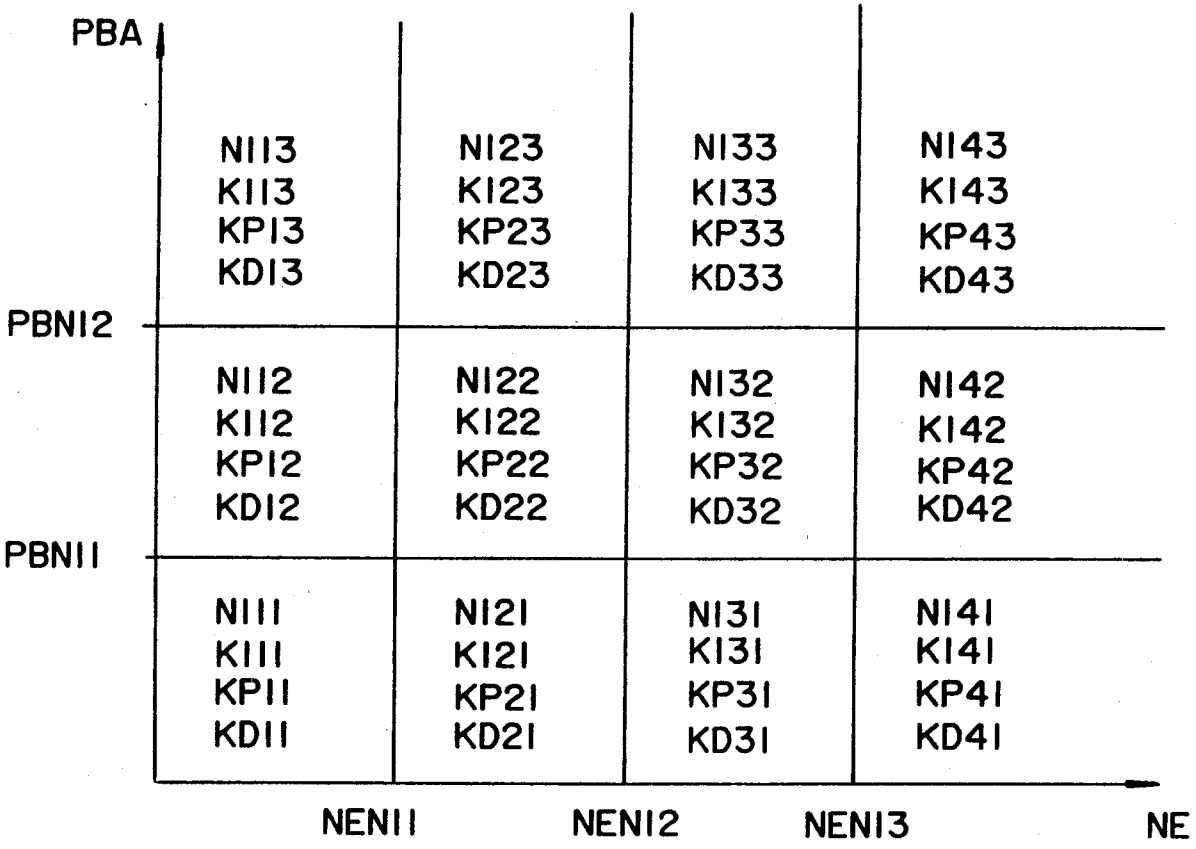
FIG. 4 is a diagram showing results of setting of NI, KI, KP, and KD effected by the program of FIG. 3.

If all of the answers to the questions of the steps S41, S43, and S45 are negative (No), i.e. if the engine is not idling, and at the same time the present loop is neither one immediately after fuel cut nor one during increased fuel supply for acceleration, in the following steps S47 to S69, the thinning-out number NI and the PID coefficients KP, KI, and KD are set according to the engine rotational speed NE and the intake pipe absolute pressure PBA, as shown in FIG. 4. Specifically, these values NI, KP, KI, and KD are set according to the relationship in magnitude between an actual value of the engine rotational speed NE and predetermined values NENI1 to NENI3 (e.g. 1000, 2500, 4000 rpm, respectively) as well as the relationship in magnitude between an actual value of the intake pipe absolute pressure PBA and predetermined values PBNI1 and PBNI2 (e.g. 360, 560 mmHg, respectively). In this connection, in the present embodiment, the predetermined NE and PBA values NENI1 to NENI3, PBNI1 and PBNI2 used for determination of these relationships in magnitude (at steps S47, S48, S50, S53, S54, S56, S59, S60, S62, S65, and S67 in FIG. 3) are each provided with a hysteresis between the time the parameter value increases and the time it decreases.

(1) If NE≦NENI1,
- (1-1) If PBA<PBNI1: NI=NI11 (e.g. 4), KI=KI11 (e.g. 0.25), KP=KP11 (e.g. 0), and KD=KD11 (e.g. 0).
- (1-2) If PBNI1≦PBA<PBNI2: NI=NII2 (e.g. 4), KI=KI12 (e.g. 0.6), KP=KP12 (e.g. 1.2), and KD=KDI2 (e.g. 0.8).
- (1-3) If PBNI2≦PBA: NI=NI13 (e.g. 2), KI=KI13 (e.g. 0.6), KP=KP13 (e.g. 0.95), and KD=KDI3 (e.g. 0.25).

(2) If NENI1<NE≦NENI2,
- (2-1) If PBA<PBNI1: NI=NI21 (e.g. 4), KI=KI21 (e.g. 0.3), KP=KP21 (e.g. 1.15), and KD=KD21 (e.g. 0.4).
- (2-2) If PBNI1≦PBA<PBNI2: NI=NI22 (e.g. 2), KI=KI22 (e.g. 0.3), KP=KP22 (e.g. 1.05), and KD=KD22 (e.g. 0.4).
- (2-3) If PBNI2≦PBA: NI=NI23 (e.g. 2), KI=KI23 (e.g. 0.35), KP=KP23 (e.g. 0.95), and KD=KD23 (e.g. 0.25).

(3) If NENI2<NE≦NENI3,
- (3-1) If PBA<PBNI1: NI=NI31 (e.g. 4), KI=KI31 (e.g. 0.3), KP=KP31 (e.g. 1.1), and KD=KD31 (e.g. 0.4).
- (3-2) If PBNI1≦PBA<PBNI2: NI=NI32 (e.g. 2), KI=KI32 (e.g. 0.35), KP=KP32 (e.g. 0.95), and KD=KD32 (e.g. 0.4).
- (3-3) If PBNI2≦PBA: NI=NI33 (e.g. 2), KI=KI33 (e.g. 0.4), KP=KP33 (e.g. 0.85), and KD=KD33 (e.g. 0.3).

(4) If NE>NENI3,
- (4-1) If PBA<PBNI1: NI=NI41 (e.g. 2), KI=KI41 (e.g. 0.35), KP=KP41 (e.g. 1.05), and KD=KD41 (e.g. 0.4).
- (4-2) If PBNI1≦PBA<PBNI2: NI=NI42 (e.g. 2), KI=KI42 (e.g. 0.35), KP=KP42 (e.g. 0.9), and KD=KD42 (e.g. 0.4).
- (4-3) If PBNI2≦PBA: NI=NI43 (e.g. 2), KI=KI43 (e.g. 0.4), KP=KP43 (e.g. 0.8), and KD=KD43 (e.g. 0.35).

Referring again to FIG. 2, at a step S28, it is determined whether or not the absolute value of the present value $DKAF_N$ of the difference calculated at the step S24 is larger than a predetermined value DKPID. If the answer to this question is negative (No), i.e. if $|DKAF_N| \leqq DKPID$, the program jumps to a step S30, whereas if the answer is affirmative (Yes), i.e. if $|DKAF_N| > DKPID$, both the immediately preceding value $DKAF_{N-1}$ and the present value $DKAF_N$ of the difference are set to a value of 0 at a step S29, and then the program proceeds to the step S30, where the proportional term KLAFP, the integral term KLAFI, and the differential term KLAFD are calculated according to the following equations (2) to (4):

$$KLAFP = DKAF_N \times KP \quad (2)$$

$$KLAFI = KLAFI + DKAF_N \times KI \quad (3)$$

$$KLAFD = (DKAF_N - DKAF_{N-1}) \times KD \quad (4)$$

Therefore, if the answer to the question of the step S28 is affirmative (Yes), i.e. if $|DKAF_N| > DKPID$, it follows that KLAFP=KLAFD=0, and KLAFI=KLAFI, since both the values $DKAF_N$ and $DKAF_{N-1}$ are set to 0 at the step S29. In other words, the feedback control by the proportional term and differential term is stopped, and the integral term is held at the immediately preceding value.

Thus, when the actual air-fuel ratio KACT is violently fluctuated as at an early stage of acceleration or when misfire occurs, which leads to $|DKAF_N| > DKPID$, the feedback control by the proportional term and the differential term is stopped, and the integral term is held at the immediately preceding value, which enables to prevent large fluctuations in the air-fuel ratio, which lead to degradation in driveability and exhaust emission characteristics.

At steps S31 to S34, limit checking of the integral term KLAFI calculated as above is carried out. More specifically, the calculated value of the integral term KLAFI is compared with predetermined upper and lower limit values LAFIH and LAFIL at steps S31 and S32. If the integral term KLAFI exceeds the upper limit value LAFIH, it is set to the upper limit value LAFIH, whereas if it is smaller than the lower limit value LAFIL, it is set to the lower limit value LAFIL.

At a step S35, the air-fuel ratio correction coefficient KLAF is calculated by adding up the PID terms KLAFP, KLAFI, and KLAFD. Then, the immediately preceding value $DKAF_{N-1}$ of the aforementioned difference is set to the present value $DKAF_N$ of same at a step S36, and the thinning-out variable NITDC is set to the thinning-out number NI calculated at the step S27 at the step S37, followed by terminating the present program.

What is claimed is:

1. An air-fuel ratio control method for an internal combustion engine having an exhaust passage, and an exhaust gas ingredient concentration sensor arranged in said exhaust passage for detecting the concentration of an ingredient in exhaust gases from said engine, wherein an amount of fuel to be supplied to said engine is calculated by the use of output from said exhaust gas ingredient concentration sensor to thereby feedback-control the air-fuel ratio of a mixture supplied to said engine to a desired air-fuel ratio, and when said engine is in a predetermined decelerating condition, fuel supply to said engine is cut off, the method comprising the steps of:

(1) determining whether or not a predetermined time period has elapsed after said engine shifted from said predetermined decelerating condition to an operating condition other than said predetermined decelerating condition; and (2) setting a rate of correction of the air-fuel ratio of said mixture by said feedback control to a larger value before said predetermined time period elapses after said engine shifted from said predetermined decelerating condition to said operating condition other than said predetermined decelerating condition, than values to be set after said predetermined time period has elapsed after said engine shifted from said predetermined decelerating condition to said operating condition other than said predetermined decelerating condition.

2. An air-fuel ratio control method according to claim 1, wherein said exhaust gas ingredient concentration sensor has output characteristics approximately proportionate to the concentration of said ingredient in said exhaust gases.

3. An air-fuel ratio control method according to claim 2, wherein said amount of fuel to be supplied to said engine is determined by multiplying a basic fuel amount by a desired air-fuel ratio coefficient representing said desired air-fuel ratio, and an air-fuel ratio correction coefficient calculated based on said desired air-fuel ratio coefficient and an equivalent ratio representing an actual air-fuel ratio which is commensurate with said output from said exhaust gas ingredient concentration sensor, said rate of correction of the air-fuel ratio of said mixture by said feedback control being determined by a rate of correction of said air-fuel ratio correction coefficient.

4. An air-fuel ratio control method according to claim 3, wherein said air-fuel ratio correction coefficient is obtained by adding up a proportional term, an integral term, and a differential term, said proportional, integral and differential terms being calculated by the use of respective predetermined coefficients and a difference between said desired air-fuel ratio coefficient and said equivalent ratio representing said actual air-fuel ratio, said rate of correction of said air-fuel ratio correction coefficient being determined by said predetermined coefficients.

5. An air-fuel ratio control method according to claim 4, wherein said proportional, integral and differential terms are calculated by multiplying said respective predetermined coefficients by said difference between said desired air-fuel ratio coefficient and said equivalent ratio, said respective predetermined coefficients being set to larger values before said predetermined time period elapses after said engine shifted from said predetermined decelerating condition to said operating condition other than said predetermined decelerating condition, than values to be set after said predetermined time period has elapsed after said engine shifted from said predetermined decelerating condition to said operating condition other than said predetermined decelerating condition.

6. An air-fuel ratio control method according to claim 5, wherein said desired air-fuel ratio coefficient having a value thereof assumed a second predetermined time period earlier than a present time is applied to said calculation of said proportional, integral and differential terms.

7. An air-fuel ratio control method according to claim 6, wherein said second predetermined time period is determined by a number of TDC signal pulses generated during a time period from the time fuel injection is effected to the time the resulting exhaust gases reach said exhaust gas ingredient concentration sensor.

8. An air-fuel ratio control method according to claim 4, wherein said air-fuel ratio correction coefficient is renewed whenever a predetermined number of TDC signal pulses are generated, said predetermined number of TDC signal pulses being dependent on operating conditions of said engine, said rate of correction of said air-fuel ratio correction coefficient being also determined by said predetermined number of TDC signal pulses.

9. An air-fuel ratio control method according to claim 8, wherein said predetermined number of TDC signal pulses is set to a smaller value before said predetermined time period elapses after said engine shifted from said predetermined decelerating condition to said operating condition other than said predetermined decelerating condition, than values to be set after said predetermined time period has elapsed after said engine shifted from said predetermined decelerating condition to said operating condition other than said predetermined decelerating condition.

* * * * *